United States Patent [19]

Adams

[11] Patent Number: 4,790,684

[45] Date of Patent: Dec. 13, 1988

[54] ROADWAY WARNING SYSTEM

[75] Inventor: Wilbur R. Adams, Terre Haute, Ind.

[73] Assignee: Simulators Limited, Inc., Terre Haute, Ind.

[21] Appl. No.: 74,260

[22] Filed: Jul. 16, 1987

Related U.S. Application Data

[63] Continuation-in-part of Ser. No. 65,937, Jun. 23, 1987.

[51] Int. Cl.[4] ..... E01F 9/04; E01F 9/10

[52] U.S. Cl. ..... 404/16; 404/1; 116/63 R

[58] Field of Search ..... 404/1, 6, 7, 9, 12, 404/15, 16; 116/63 R, 63 P

[56] References Cited

U.S. PATENT DOCUMENTS

| | | | |
|---|---|---|---|
| 1,740,501 | 12/1929 | Eckstrand | 404/16 |
| 2,330,808 | 10/1943 | Bingham | 404/16 |
| 2,457,512 | 12/1948 | Wheeler | 404/15 |
| 4,012,156 | 3/1977 | Turner | 404/15 |
| 4,135,839 | 1/1979 | Engwall | 404/16 |
| 4,342,525 | 8/1982 | Mastronuzzi, Jr. | 404/6 |
| 4,362,424 | 12/1982 | Barber | 404/6 |
| 4,490,069 | 12/1984 | Cushman et al. | 404/15 |

FOREIGN PATENT DOCUMENTS

| | | | |
|---|---|---|---|
| 878057 | 6/1953 | Fed. Rep. of Germany | 116/63 R |
| 3144577 | 5/1983 | Fed. Rep. of Germany | 116/63 R |
| 2036140 | 6/1980 | United Kingdom | 404/15 |
| 2175335 | 11/1986 | United Kingdom . | |

*Primary Examiner*—Stephen J. Novosad
*Assistant Examiner*—John F. Letchford
*Attorney, Agent, or Firm*—Howrey & Simon

[57] ABSTRACT

A warning system for multi-lane roadways comprising a group of strips placed longitudinally across only the left-most lane of the roadway as referenced by a person facing in the designated direction of traffic flow.

8 Claims, 2 Drawing Sheets

ROADWAY WARNING SYSTEM

This application is a continuation-in-part application of Ser. No. 065,937, titled "Prefabricated Pavement Devices," filed by Wilbur R. Adams on June 23, 1987.

BACKGROUND OF THE INVENTION

The present invention relates to a warning system for multi-lane roadways, particularly divided highways and limited access highways having entrance and exit ramps. Such highways present a danger to distracted or inattentive drivers who enter a divided highway on the wrong side, perhaps by mistaking an exit ramp for an entrance ramp or an entrance ramp for an exit ramp. Prior art solutions to this problem involve the posting of signs such as "WRONG WAY", "ONE WAY", or "GO BACK". Signs, however, are of little use to inattentive drivers who might not see them. Furthermore, signs can be rendered ineffective by darkness, rain or fog and can be completely removed or destroyed by collisions with passing vehicles. If a motorist does not see the sign or if the sign is missing, the motorist will proceed onto the multi-lane highway in the wrong direction with possibly tragic results. Warning signs are therefore an inadequate solution to the problem.

Also known in the prior art of roadway warning systems is a series of raised pavement strips known as rumble strips. Rumble strips, however, typically extend across a series of lanes and have never been used as a means for warning motorists driving the wrong way on entrance or exit ramps.

SUMMARY OF THE INVENTION

The present invention overcomes the disadvantages of prior art warning systems by providing a roadway warning system that can be felt and heard as well as seen.

According to this invention, a plurality of raised strip members are attached substantially across only one lane of a multi-lane roadway. The strips are placed such that motorists driving the wrong way on a multi-lane roadway will encounter the strips in their right-most lane while motorists driving the correct direction will encounter the strips in their left-most lane.

DETAILED DESCRIPTION OF THE DRAWINGS

The roadway warning system according to the preferred embodiment of the instant invention will be described with reference to the accompanying drawings.

Figure 1:
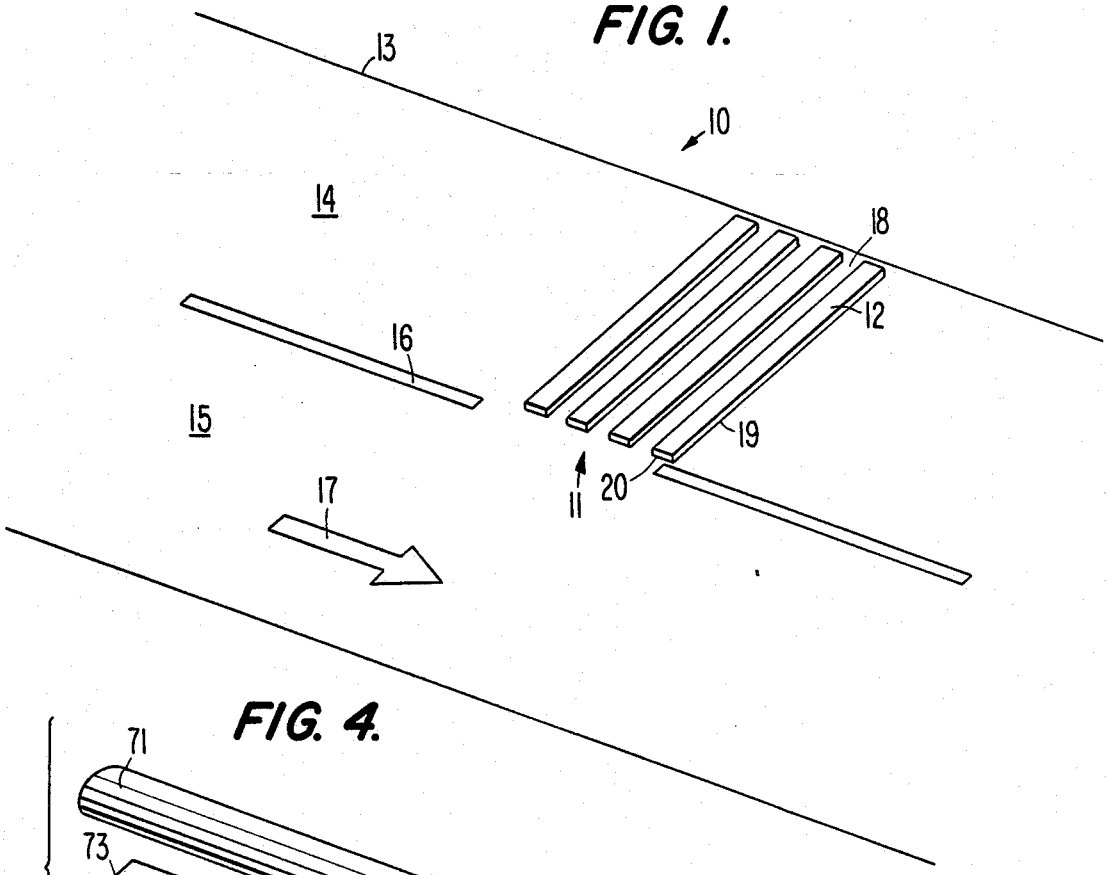
FIG. 1 is an elevational view of one side of a multi-lane highway embodying the warning device of the instant invention.

FIG. 1 shows one unit 10 of the warning system. The group 11 of raised strips 12 is formed by alternating strip members 12 and spaces 18. Four strip members 12 are depicted in FIG. 1, but any number of strips will do. Each strip member 12 is formed with a first edge 19 and a second edge 20, said first edge 19 being longer than said second edge 20. First edge 19 and second edge 20 form two sides of the bottom face (not shown) of strip member 12. While the strip members 12 shown in FIG. 1 have rectangular cross-sections, the strip members may also have rounded or tapered cross-sections as well.

The warning system unit 10 further comprises one side 13 of a multi-lane divided highway. Lanes 14 and 15 of the one side 13 of the highway are both designated for traffic flow in the direction of arrow 17. While only two lanes are shown, the invention is not limited to double multi-lanes but may be applied to a multi-lane divided highway having any number of lanes. While lanes 14 and 15 are shown separated by broken dividing line 16, line 16 is not an essential part of the invention.

It can be seen from FIG. 1 that group 11 is placed in lane 14 with strip members 12 extending substantially across lane 14. It will be understood that lane 14 is the left-most lane of highway side 13 for a person facing in the direction of arrow 17.

The strip members 12 may be colored to contrast with the pavement. The length of second edge 20 is typically in the range of 2 to 6 inches. The strip members have a vertical rise above the highway pavement of between $\frac{1}{2}''$ and $1\frac{1}{4}''$. The invention is in no way limited to these dimensions, however. The length of first edge 19 may be varied to accommodate the highway width but will in any event be equal to or less than the width of lane 14.

Figure 2:
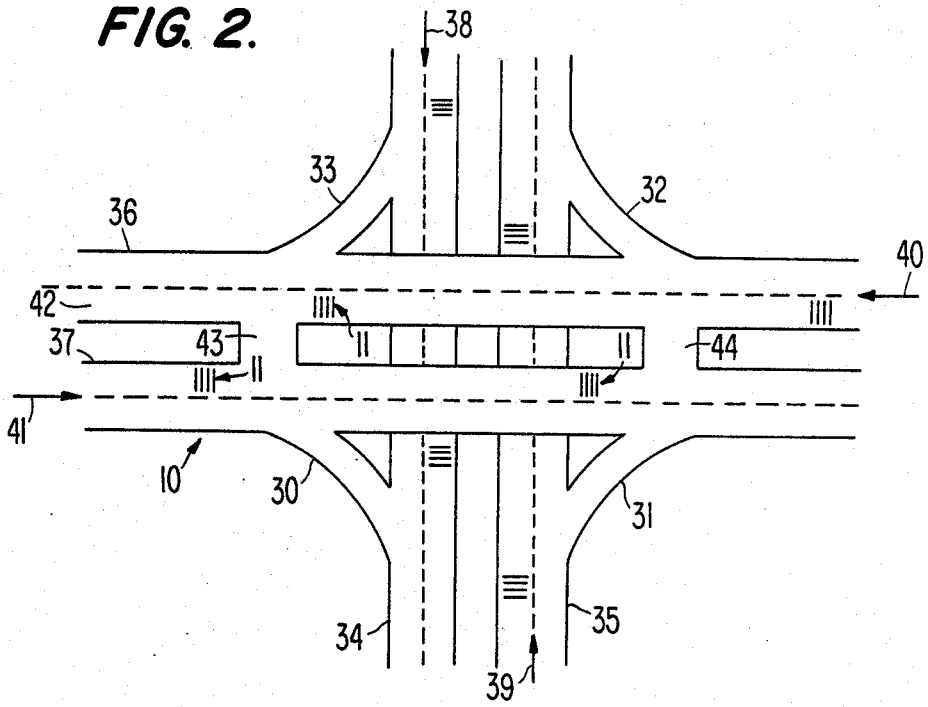
FIG. 2 is a schematic drawing showing the placement of the instant invention in a diamond exit configuration at the intersection of two multi-lane highways.

FIG. 2 shows a preferred application of this invention to a diamond exit at the intersection of two multi-lane limited access highways. The configuration shown comprises eight warning system units 10, two in each of highway sides 34, 35, 36 and 37. The designated traffic flow directions of highway sides 34, 35, 36 and 37 are shown by arrows 38, 39, 40 and 41, respectively.

With reference to highway side 36, it can be seen that one group 11 of strips 12 is placed in the left-most lane 42 of highway side 36 from the perspective of a person facing direction 40 and adjacent to and 37 upstream" from entrance ramp 33 and crossover 43. A second group 11 of strips 12 is placed in lane 42 of highway side 36 adjacent to and upstream from ramp 32 and crossover 44. Groups of strips are similarly placed on highway sides 34, 35 and 36 as shown in FIG. 2.

By way of illustration, if a motorist, instructed in the use of this invention, in a vehicle traveling in direction 38 on highway side 34 turns right onto ramp 33 and left onto highway side 36, i.e., against the designated traffic flow 40, the motorist will encounter the group of strips 11 as the vehicle moves into lane 42, i.e., the motorist's right-most lane. The sight of the approaching group of strips 11 as well as the sound and feel of the strips as the vehicle passes over them will alert the motorist that he is traveling the wrong way on that side of the multi-lane highway. By way of contrast, a motorist, instructed in the use of this invention, traveling on highway side 36 in direction 40 will encounter strips 11 in his left-most lane—lane 42—and will thus know that he is moving in the correct direction on that highway.

Figure 3:
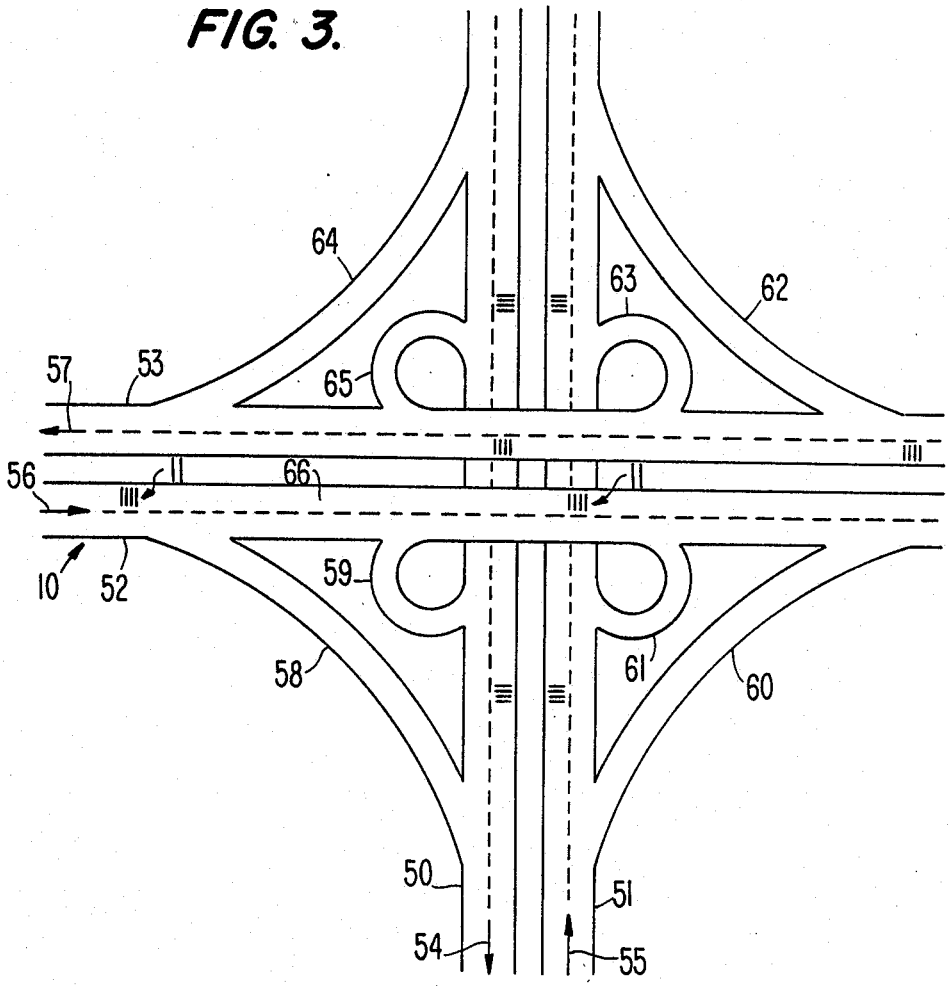
FIG. 3 is a schematic drawing showing the placement of the instant invention in a full clover leaf exit configuration at the intersection of two multi-lane highways.

FIG. 3 shows a preferred application of the instant invention to a full clover leaf exit at the intersection of two multi-lane highways. The configuration shown comprises eight highway warning system units 10, two in each of highway sides 50, 51, 52 and 53. The designated flow directions of highway sides 50, 51, 52 and 53 are shown by arrows 54, 55, 56 and 57, respectively.

With reference to highway side 52, it can be seen that one group of strips 11 is placed in the left-most lane 66 of highway side 52 from the perspective of a person facing direction 56 and adjacent to and upstream from ramp 58. A second group of strips 11 is placed in lane 66 of highway side 52 adjacent to and upstream from ramp 61 and downstream of ramp 59. Groups of strips 11 are similarly placed on highway sides 50, 51 and 52 as shown in FIG. 3.

The warning system 10 of this invention could also be applied to a one-way street. Thus element 13 of FIG. 1 would be a multi-lane one-way street having a designated traffic flow direction 17. By way of illustration, a motorist entering one-way street 13 against the flow of traffic 17 would move into lane 14, the motorist's right-most lane. There the motorist will encounter the group of strips 11. The sight of the approaching strips as well as the sound and feel of the strips as the vehicle passes over them will alert the motorist, instructed in the use of this invention, that he is traveling the wrong way on a one-way street.

While any suitable style of strip may be used, one preferred strip design will be described with reference to FIG. 4. The strip 12 is a composite device comprised essentially of an upper pavement mixture portion 71 and a lower support portion 72. Pavement mixture portion 71 may be formed from bituminous emulsions or aggregate and bituminous emulsions or any other suitable material. In the preferred embodiment, support portion 72 is formed from rolls of stock wire, plastic mesh or any suitable support material cut to predetermined widths. Below the pavement mixture portion 71 and above the support portion 72 is an adhesive layer 73 which binds the pavement mixture to the support. In the preferred embodiment, adhesive layer 73 may be a standard epoxy or any other suitable adhesive.

Figure 4:
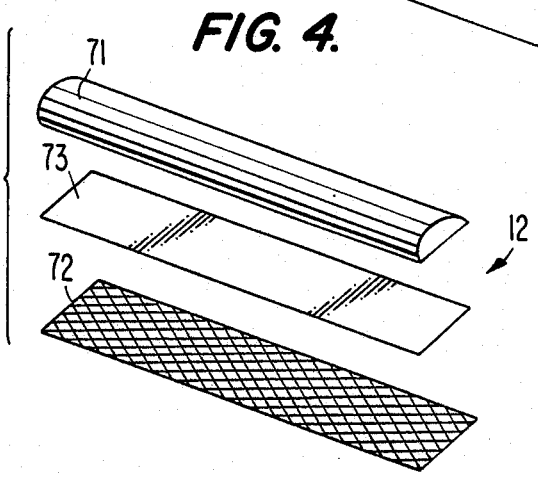
FIG. 4 is a blow-up view of one embodiment of a pavement strip for use with this invention.
Figure 6:
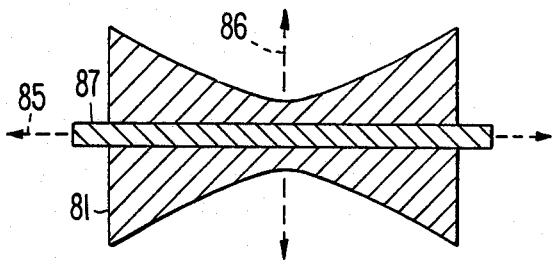
FIG. 6 is a sectional view of a roller from an apparatus for making a pavement strip for use with this invention.
Figure 5:
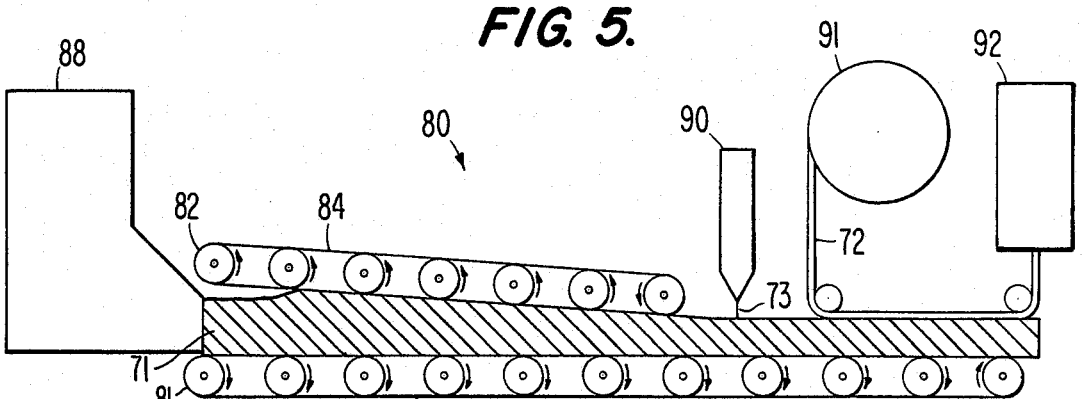
FIG. 5 is a schematic drawing of an apparatus for making a pavement strip for use with this invention.

FIGS. 5 and 6 show in schematic form a method and machine for making the composite pavement strip shown in FIG. 4. According to the preferred method of making these devices, a machine 80 comprises two sets of rollers 81 and 82 surrounded by continuous flexible belts 83 and 84, respectively. The rollers may be formed from stainless steel or any other suitable material. Rollers 82 are substantially cylindrical. Rollers 81 may have sloped or concave cross-sections as shown in FIG. 6. The roller shown in FIG. 6 has a small transverse diameter at its center and slopes radially outward toward both ends. The roller 81 is substantially symmetrical about imaginary axes 85 and 86. Axle 87 passes through roller 81 along imaginary longitudinal axis 85. Axle 87 is threaded at both ends for attachment to conventional roller driving means (not shown). Alternatively, rollers 81 may also be substantially cylindrical.

As shown in FIG. 5, rollers 81 are arranged horizontally and are surrounded by flexible belt 83. Rollers 81 are driven by conventional driving means (not shown), rotating clockwise about axle 87. Rollers 82 are arranged above rollers 81 and belt 83. Rollers 82 are surrounded by flexible belt 84 and are rotated counterclockwise as shown in FIG. 5 about their longitudinal axes by conventional driving means (not shown). The central longitudinal axes of rollers 82 are arranged to slope downwards from the first roller to the last.

In operation, pavement mixture 71 is fed continuously from dispenser 88 onto flexible belt 83. Rotating rollers 81 and 83 propel the pavement mixture 71 forward from left to right as shown in FIG. 5. As the pavement mixture 71 moves forward it is pressed between the downwardly sloped rollers 82 and the horizontal rollers 81. As it is pressed between the two sets of rollers, the pavement mixture takes the shape of the rollers. If concave rollers 81 as shown in FIG. 6 are used, the bottom side of the pavement mixture 71 will have a convex shape while the top side will be substantially flat. If cylindrical rollers 81 are used, both top and bottom sides of pavement mixture 71 will be flat. The thickness, i.e., the distance between the top and bottom sides of the pavement mixture will be determined by the spacing between the sets of rollers 81 and 82. The width of the pavement mixture will be determined by the volume flow rate of pavement mixture 71 from dispenser 88 and the rotational velocity of rollers 81 and 82.

Rollers 82 and flexible belt 84 extend only part way along rollers 81 and belt 83. After being formed to a predetermined size and shape by rollers 81 and 82 as described above, the pavement mixture continues along moving rollers 81 and belt 83. An adhesive 73 such as epoxy is applied to the top side of the shaped pavement mixture by a conventional adhesive dispenser 90. The support portion 72 - metal or plastic mesh in the preferred embodiment - is dispensed from storage roll 91 applied to the top side of the pavement mixture and attached thereto by adhesive 73.

The composite pavement mixture and support is fed continuously to cutting means 92 to form into individual strips 12. This cutting means may be conventional shears for making a straight edge. The pavement strip 12 thus formed may be attached to the highway with epoxy or any other suitable adhesive means.

I claim:

1. A warning system for a multi-lane roadway, said system comprising a roadway extending in a first direction and in a second direction, said roadway having a first plurality of lanes designated for traffic flow in said first direction, said system further comprising a plurality of strip members, said strip members having a bottom side and a first edge and a second edge, said first edge being longer than said second edge, wherein said bottom side of said strip members are attached to said roadway in a grouped and spaced fashion such that said first edges are substantially parallel to each other, said group of strip members being placed only in the left-most lane as referenced by persons situated in said first plurality of lanes and facing said first direction and in the right-most lane as referenced by persons situated in said first plurality of lanes and facing opposite said first direction.

2. The roadway warning system of claim 1 wherein said bottom side is bounded by said first and second edges.

3. The roadway warning system of claim 2 wherein said strip members are a color other than the color of the highway.

4. The warning system of claim 1 wherein said strip members have substantially rectangular cross-sections.

5. The warning system of claim 1 wherein said strip members extend substantially across said left-most lane as referenced by persons facing said first direction.

6. A method for warning operators of vehicles on a multi-lane roadway having a plurality of lanes designated for traffic flow in a first direction, comprising the step of attaching a plurality of raised, elongated strips transversely across only the left-most lane, as referenced by persons facing said first direction, subsantially near an entrance to the multi-lane roadway.

7. The method of claim 6 further comprising the step of coloring said raised strips a color other than the color of the roadway.

8. The method of claim 6 further comprising the steps of forming each of said raised strips with an elongated first edge and a second edge, and placing said strips such that said first edge of each of said raised strips is parallel to the first edges of each other raised strip.

* * * * *